United States Patent [19]

DeSarno

[11] Patent Number: 4,998,551

[45] Date of Patent: Mar. 12, 1991

[54] UMBRELLA WITH CANOPY ROTATOR JOINT

[75] Inventor: James G. DeSarno, Interlaken, N.J.

[73] Assignee: Winpro Industries, Interlaken, N.J.

[21] Appl. No.: 302,984

[22] Filed: Jan. 30, 1989

[51] Int. Cl.[5] ..... A45B 11/00

[52] U.S. Cl. ..... 135/20 R; 135/35 V; 403/165

[58] Field of Search ..... 135/20 R, 25 R, 35 V, 135/43, 28; 403/78, 72, 164, 165

[56] References Cited

U.S. PATENT DOCUMENTS

| | | | |
|---|---|---|---|
| 539,762 | 5/1895 | Barnett | 135/27 |
| 559,577 | 5/1896 | Hadfield | 135/27 |
| 850,341 | 4/1907 | Callahan | 135/27 |
| 1,378,354 | 5/1921 | Johnson | 135/27 X |
| 1,532,802 | 4/1925 | Feistner | 135/20 R X |
| 2,729,220 | 1/1956 | Smyrnow | 135/66 X |
| 3,032,047 | 5/1962 | Wendorf | 135/35 |
| 3,861,410 | 1/1975 | Cognet | 135/20 R |
| 4,300,582 | 11/1981 | DeSarno | 135/20 R |
| 4,407,317 | 10/1983 | Crandall | 135/27 |
| 4,865,063 | 9/1989 | Williams | 135/35 V |

*Primary Examiner*—David A. Scherbel
*Assistant Examiner*—Lan Mai
*Attorney, Agent, or Firm*—Kramer, Brufsky & Cifelli

[57] ABSTRACT

A storm umbrella comprises a canopy, a center pole, a first sleeve slidably mounted on the center pole, and a plurality of outer ribs extending outwardly from a top of the pole and forming a frame for the canopy. A plurality of intermediate ribs are each connected at one end to a corresponding one of the outer ribs and connected at another end to the first sleeve to support the outer ribs and open and close the canopy. In one embodiment of the invention, the center pole is divided and a rotational joint is connected between upper and lower portions of the center pole. In a second embodiment, the center pole is not divided and the rotational joint is connected between the center pole and a handle for the umbrella. Consequently, in either embodiment, when the canopy is subject to a torsional force, the canopy can rotate relative to the handle to shunt the force. This avoids damage to the umbrella and makes the umbrella easier to hold by a person.

4 Claims, 2 Drawing Sheets

UMBRELLA WITH CANOPY ROTATOR JOINT

BACKGROUND OF THE INVENTION

The invention relates generally to umbrellas, and deals more particularly with a canopy rotator joint in an umbrella which joint allows the canopy to rotate during high winds and thereby avoid damage.

Winds can exert various types of forces on an umbrella canopy. One such force acts against the inner surface of the canopy longitudinally of the umbrella shaft, and can turn the umbrella canopy inside out. Many attempts have been made to reinforce the canopy against such reaction. For example, U.S. Pat. No. 3,032,047 to Wendorf discloses a storm umbrella which includes a peripheral cord secured to ends of outer ribs, as well as a series of guy assemblies attached to the ends of the outer ribs and to a sleeve on the center pole. This will apparently keep the ends of the ribs from being drawn outwardly to turn the umbrella inside out. Also, U.S. Pat. No. 4,300,582 to Desarno discloses another storm umbrella which includes an annular ring of flexible material around the periphery of the bottom, outer portion of the canopy between the ribs. The inner portion of the annular ring of flexible material is secured to a continuous cord of flexible, but not stretchable material. The outer portion of the ring of flexible material secures the fabric of the canopy as well as the ends of the ribs, and, together with the inner cord, prevents the entire structure from being turned inside out or otherwise damaged in high winds.

The winds can also exert a torsional force on the canopy which tends to twist the canopy and the ribs which support it. This may cause damage to the ribs and make it difficult for a person to hold the umbrella. The potential for damage to the ribs is exacerbated in an umbrella which has a canopy reinforced against turnout because such a canopy traps the wind underneath the canopy.

Accordingly, a general object of the present invention is to provide an improvement to an umbrella which renders the umbrella less susceptible to damage caused by high winds.

A more specific object of the invention is to provide such an improvement which is usable with the reinforced umbrella described in U.S. Pat. No. 4,300,582 as well as other umbrellas with or without a reinforced canopy.

SUMMARY OF THE INVENTION

The invention is an improvement to a storm umbrella comprising a canopy, a center pole for supporting the canopy, a first sleeve slidably mounted on the center pole, and a plurality of outer ribs extending radially from a top of the pole and forming a frame for the canopy. A plurality of intermediate ribs are each connected at one end to a corresponding one of the outer ribs and connected at the opposite end to the first sleeve to support the outer ribs and open and close the canopy.

In one embodiment of the invention, the center pole is divided into an upper portion and a lower portion, and a rotational joint is connected between the upper and lower portions of the center pole, for rotatably supporting the upper portion of the pole on the lower portion of the pole. Consequently, when the canopy is subject to a torsional force caused by high winds, the canopy and the upper pole portion rotate relative to the lower pole portion to shunt the force.

In another embodiment of the invention, the center pole is not divided, and the rotational joint is located between the lower end of the pole and a handle of the umbrella.

According to one feature of the invention, the rotational joint comprises a second sleeve which is fixedly attached to the upper pole portion in the first embodiment of the invention or the lower end of the undivided pole in the second embodiment of the invention, and a hub which is fixedly attached to the lower pole portion in the first embodiment of the invention or the handle in the second embodiment of the invention. The second sleeve has an annular, inner notch which is rotatably mounted on an annular recess on the hub to permit the rotation of the canopy relative to the handle while preventing longitudinal motion of the second sleeve relative to the hub.

DETAILED DESCRIPTION OF THE PREFERRED EMBODIMENTS

Figure 1:
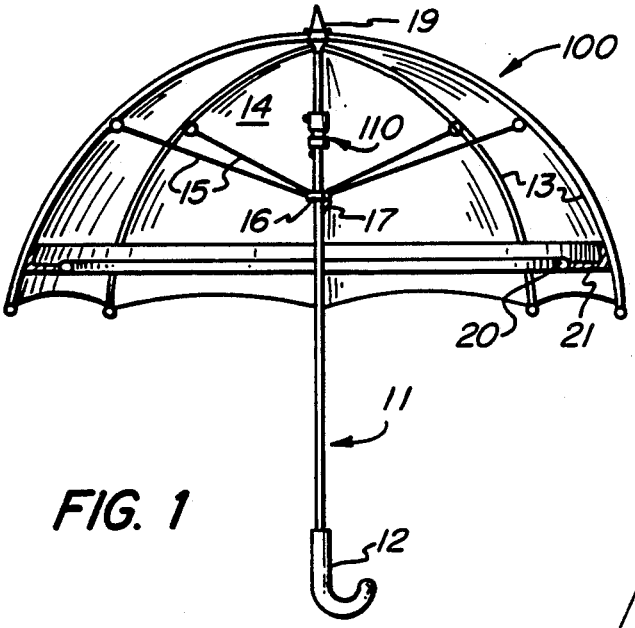
FIG. 1 is a side view, partly in cross-section, of an umbrella including a canopy rotator joint according to the present invention.

Referring now to the Figures in detail wherein like reference numerals indicate like elements throughout the several views, FIG. 1 illustrates an open umbrella generally designated 100 embodying the present invention. Umbrella 100 comprises a center pole 11 and a fixedly attached handle 12. In the open position of the umbrella, outer ribs 13 extend outwardly from a top 19 of the center pole, and are spaced radially from the center pole by intermediate ribs 15. Ribs 13 and 15 provide a frame for a canopy 14. Intermediate ribs 15 converge upon and are attached to a ring or sleeve 16 which is slidably and rotatably mounted on the center pole. Sleeve 16 is operable to open or close the canopy by longitudinal movement on pole 11. A spring biased catch 17 is provided to releasably fix the sleeve in the upper, open position as shown in FIG. 1. Although not shown, another catch may be provided adjacent to handle 12 to fix the sleeve in a lower, closed position.

FIG. 1 also illustrates a mechanism for reinforcing the canopy against turning inside out. The mechanism includes a ring of material 21 having an outer portion secured to canopy 14 and ribs 13, and an inner portion secured to a rope 20. For further details of this mechanism, reference can be made to U.S. Pat. No. 4,300,582 to Desarno which issued November 17, 1981 and is hereby incorporated by reference as part of the present disclosure.

Figure 3:
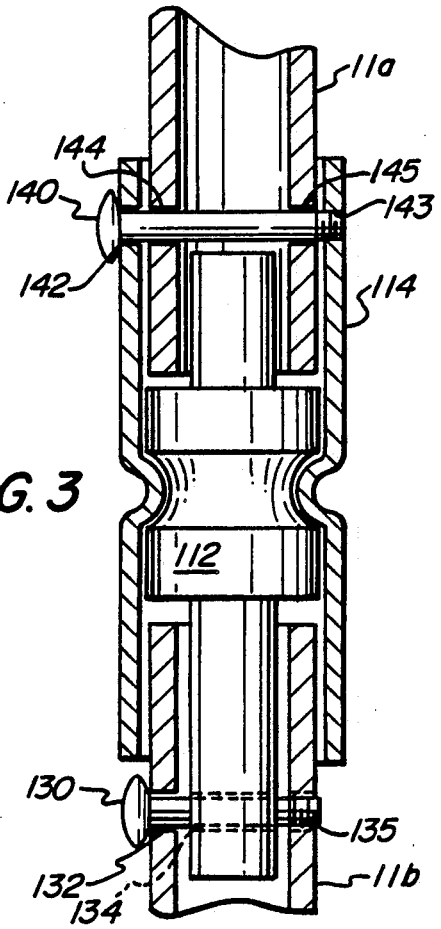
FIG. 3 is an assembled view in cross-section of the parts of FIG. 2.
Figure 2:
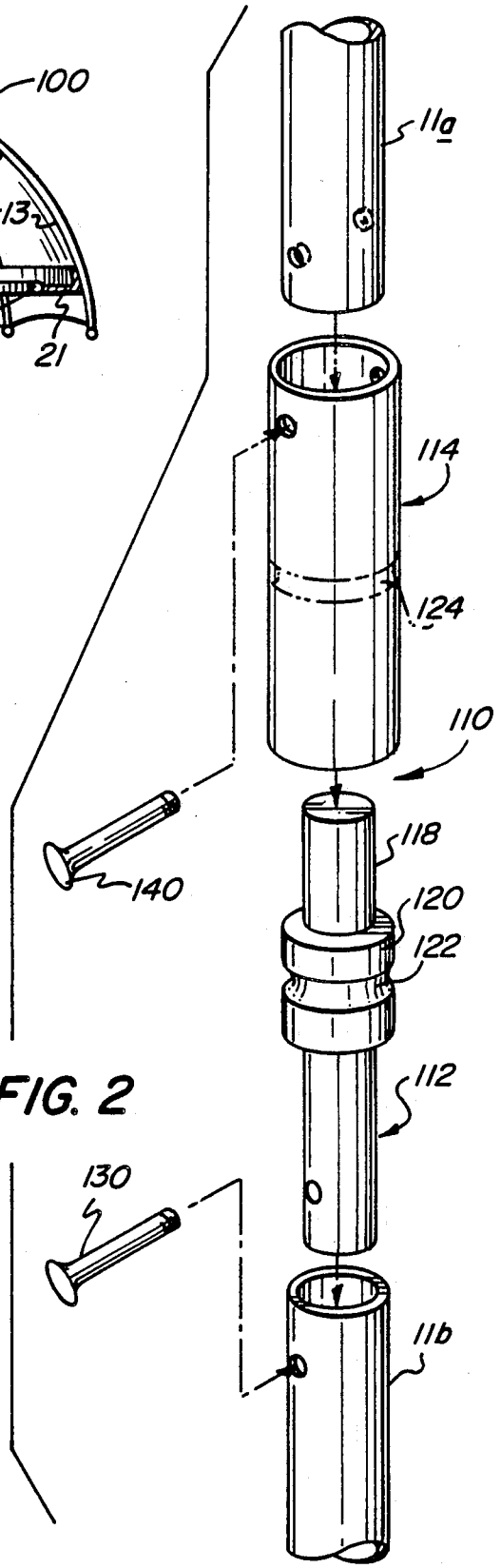
FIG. 2 is an enlarged, exploded view of the canopy rotator joint and adjacent center pole portions of the umbrella of FIG. 1.

Focusing now on the present invention, FIG. 2 illustrates that shaft 11 is separated into an upper portion 11*a* which is fixedly attached to the canopy at the top 19 of the pole, and a lower portion 11*b* which is fixedly mounted to handle 12 at the bottom of the pole. A canopy rotator joint 110 is concentrically located between pole portions 11*a* and 11*b*, which rotator joint comprises a central hub 112 and a mating sleeve 114. Hub 112 comprises a longitudinal shaft 118 and a sleeve 120 fixedly received on shaft 118. Sleeve 120 has an annular recess or race 122 which receives an annular notch 124 (shown in broken line in FIG. 2) projecting inwardly from sleeve 114. Thus, sleeve 114 is rotatably mounted on hub 112 as illustrated in FIG. 3, and the mating engagement between annular race 122 and annular, inner notch 124 prevents longitudinal movement between the hub 112 and the sleeve 114.

One way to manufacture sleeve 114 in mating engagement with hub 112 is to place a sheet of the sleeve 114 material against the sidewall of sleeve 120, and then roll the sleeve 114 sheet around sleeve 120 and simultaneously crimp the sleeve 114 material to form annular, inner notch 124.

Umbrella pole portion 11*b* is longitudinally received on the lower end of shaft 118 of hub 112 and fixedly secured thereto by a pin 130 which passes through a hole 132 in pole portion 11*b*, a hole 134 in shaft 118, and a hole 135 in pole portion 11*b*. By way of example, pin 130 is threaded at one end and threadably received in the hole 135. Alternately, however, pin 130 can be press fit in hole 135. In the illustrated embodiment, lower pole portion 11*b* is positioned within sleeve 114; however, if desired, the upper end of pole portion 11*b* can be spaced in the longitudinal direction from the lower end of sleeve 114 to avoid the possibility of friction therebetween.

The lower end of upper pole portion 11*a* is longitudinally received within the upper portion of sleeve 114 and fixedly secured thereto by a pin 140 which passes through a hole 142 in sleeve 114, holes 144 and 145 in pole portion 11*a*, and a hole 143 in sleeve 114. By way of example, pin 140 is threaded at one end and threadably received in the hole 143. Alternatively, however, pin 140 can be press fit in hole 143. In the illustrated embodiment, the lower end of pole portion 11*a* overlaps shaft 118, but if desired can be spaced longitudinally from the upper end of shaft 118 to avoid the possibility of friction therebetween. By way of example, hub 112 and sleeve 114 are made of metal or plastic, pole portions 11*a* and 11*b* are made of metal, plastic or wood, and pins 130 and 140 are made of brass.

When canopy 14 of umbrella 100 outfitted with canopy rotator joint 110 is subject to a torsional force caused, for example, by high winds, canopy 14, ribs 13 and 15, upper pole portion 11*a* and sleeve 114 rotate as a unit about hub 112 and lower pole portion 11*b*. This rotation is also made possible by the fact that sleeve 16 simultaneously rotates about lower pole portion 11*b*. Consequently, the canopy 14 does not resist or oppose the torsional force but rotates with it to avoid damage to ribs 13 and 15. Also, as a result of the rotation of canopy 14, a person holding the umbrella by handle 12 does not feel the full torsional force that would be felt if the canopy did not rotate.

Figure 4:
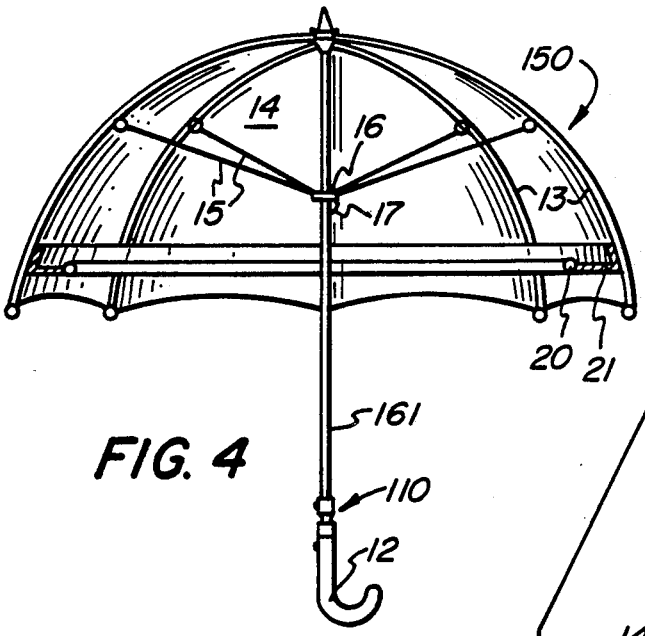
FIG. 4 is a side view, partly in cross-section of an umbrella which includes at a different location the canopy rotator joint of FIG. 1.
Figure 6:
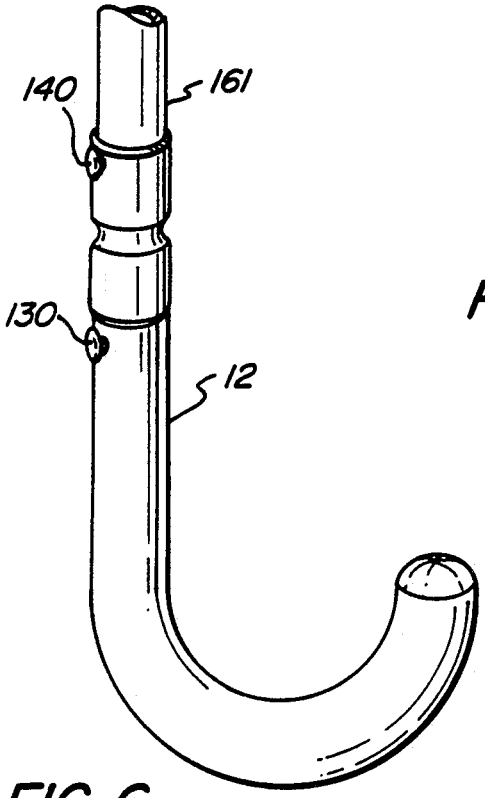
FIG. 6 is an assembled view of the parts of FIG. 5.
Figure 5:
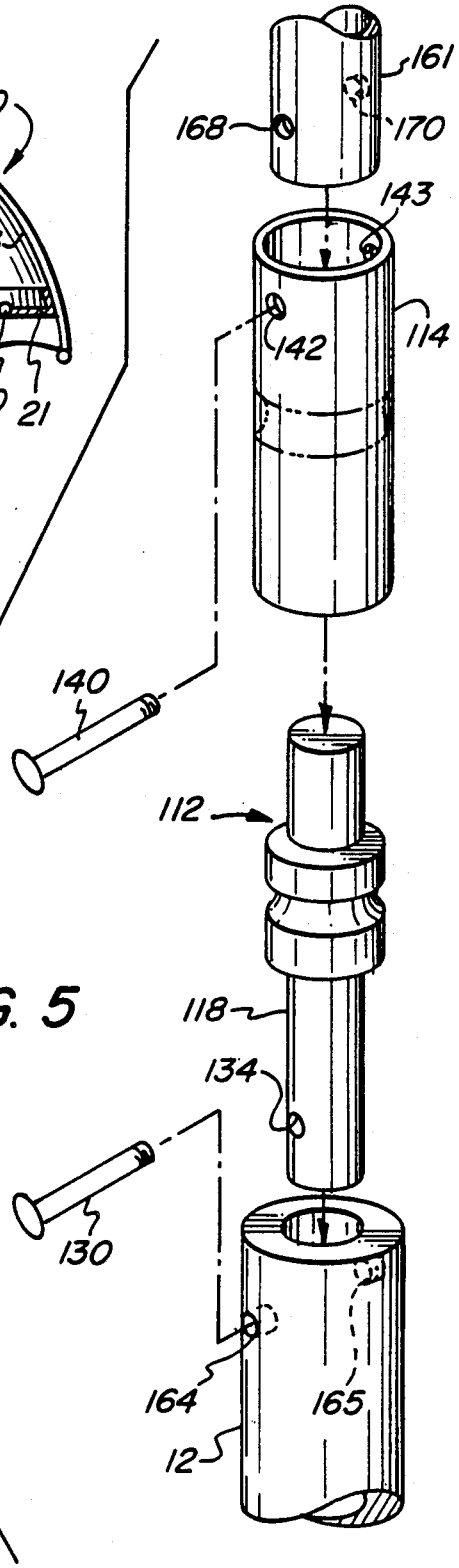
FIG. 5 is an enlarged, exploded view of the canopy rotator joint and adjacent center pole and handle of the umbrella of FIG. 4.

FIGS. 4–6 illustrate another umbrella generally designated 150 including canopy rotator joint 110 in accordance with the present invention. Umbrella 150 is similar to umbrella 100 except for the location of the canopy rotator joint. In the umbrella 150, canopy rotator joint 110 is located between handle 12 and an umbrella pole 161. Pole 161 is not divided as is pole 11 in umbrella 100.

As illustrated in FIGS. 2 and 3, the lower end of shaft 118 of hub 112 is received in a longitudinal aperture in handle 12 and fixed thereto by the pin 130 which passes through a hole 164 in handle 12 and the hole 134 in shaft 118 and is secured in hole 165 in handle 12. The lower end of center pole 161 is received within the upper end of sleeve 114 and fixedly attached thereto by the pin 140 which passes through hole 142 in sleeve 114 and holes 169 and 170 at the lower end of umbrella pole 161, and is secured in hole 143 in sleeve 114. Consequently, when canopy 14 of umbrella 150 is subjected to a torsional force, canopy 14, ribs 13 and 15, the entire pole 161, and sleeve 114 rotate about hub 112 and handle 12. In umbrella 150, sleeve 16 need not rotate about center pole 161.

Based on the foregoing, umbrellas comprising a canopy rotator joint have been disclosed in accordance with the present invention. However, numerous modifications and substitutions may be made without deviating from the scope of the invention. Therefore, the invention has been disclosed by way of illustration and not limitation and reference should be made to the following claims to determine the scope of the invention.

I claim:

1. An umbrella comprising:

a canopy;

a center pole having an upper end coupled to a center of said canopy for supporting said canopy;

a first sleeve slidably mounted on said center pole;

a plurality of outer ribs extending outwardly from said center of said canopy and forming a frame for said canopy;

a plurality of intermediate ribs each connected at one end to a corresponding one of said outer ribs and connected at another end to said first sleeve to support said outer ribs and open and close said canopy;

a handle coupled to a lower end of said center pole; and rotational joint means, connected between said handle and said center pole, for rotatably supporting said canopy relative to said handle, whereby when said canopy is subject to a torsional force, said canopy and said center pole rotate relative to said handle, said rotational joint means comprising a second sleeve fixedly and concentrically attached to said center pole, and a hub fixedly and concentrically attached to said handle, said second sleeve being rotatably mounted to said hub, wherein said second sleeve has a longitudinal aperture in receipt of said center pole, said hub comprises a longitudinal shaft, and said handle has a longitudinal aperture in receipt of said longitudinal shaft of said hub and wherein said hub has an annular recess, and said second sleeve has an annular, inner notch which is rotatably mounted in said annular recess of said hub.

2. An umbrella as set forth in claim 1 further comprising means for reinforcing said canopy against turnout.

3. An umbrella according to claim 2 wherein the reinforcing means comprises a cord attached around the inside of said canopy.

4. An umbrella according to claim 3 wherein the reinforcing means further comprises an annular ring of flexible material attached between said cord and the inside of said canopy.

* * * * *